US005493877A

United States Patent [19]

Wickremasinghe

[11] Patent Number: 5,493,877

[45] Date of Patent: Feb. 27, 1996

[54] WATER LEVEL SENSOR AND ALARM SYSTEM

[76] Inventor: Daniel R. Wickremasinghe, 26339 Timber Trail, Dearborn Heights, Mich. 48127

[21] Appl. No.: 318,236

[22] Filed: Oct. 5, 1994

[51] Int. Cl.[6] ..... D06F 37/24

[52] U.S. Cl. ..... 68/208; 68/12.21; 73/304 R

[58] Field of Search ..... 68/208, 207, 12.02, 68/12.21, 235; 134/113, 58 D, 57 D, 56 D; 73/304 R

[56] References Cited

U.S. PATENT DOCUMENTS

| | | | |
|---|---|---|---|
| 2,498,886 | 2/1950 | Geldhof et al. | 68/208 |
| 2,877,788 | 3/1959 | Clark | 68/208 |
| 3,027,908 | 4/1962 | Cochran | 68/208 |
| 3,091,111 | 5/1963 | Cruse et al. | 68/208 |
| 4,069,837 | 1/1978 | Jirasek | 68/208 |
| 4,380,243 | 4/1983 | Braley . | |
| 4,418,712 | 12/1983 | Braley . | |
| 4,449,384 | 5/1984 | Jones . | |
| 4,814,752 | 3/1989 | Lehman . | |
| 5,026,954 | 6/1991 | Cebulski . | |
| 5,028,910 | 7/1991 | Meacham et al. . | |
| 5,125,247 | 6/1992 | Mills . | |

*Primary Examiner*—Frankie L. Stinson
*Attorney, Agent, or Firm*—Dinnin & Dunn

[57] ABSTRACT

A water level sensor and alarm system for use with a washing machine. The water level sensor and alarm system includes a control box, a control circuit, a plurality of probes, and a washing machine unit and drain. The low level sensor and alarm system will connect directly to a washing machine and drain tub and/or drain conduit in order to monitor an overflow of water during the rinse cycle of a washing machine. If water has exceeded a certain height, and is beginning to overflow, the system will automatically cut all power to the washing machine unit and thus turn the washing machine unit off until the unit is reset after the clog in the drain has been corrected.

5 Claims, 3 Drawing Sheets

WATER LEVEL SENSOR AND ALARM SYSTEM

BACKGROUND OF THE INVENTION

1. Field of the Invention

The present invention relates generally to water level sensors, and more particularly to a water level sensor and alarm system for use with a washing machine.

2. Description of the Related Art

With modern automatic washing machines a problem which recurs again and again is the periodic waste water overflow which occurs when the drain line becomes clogged. As usually happens, the user of an automatic washing machine may not be in the vicinity of the machine when the drain tube becomes clogged, hence the backup of waste water being pumped from the washing machine during the automatic washing machines pump/rinse cycle results in a substantial amount of water spillage on the surrounding floor area often resulting in water damage to surrounding items and to the floor and covering such as tile, carpet or the like. Further, there is the time-consuming and irritating clean-up of the floor and any surrounding items such as clothes. In an effort to overcome the well known problem associated with washing machines, many different overflow prevention systems have been developed which usually automatically stop the washing machine when water begins to backup in the drain tube. However, to date, a cost effective simple mechanism to solve the above problem has yet to be found.

Representative of previous efforts to solve this problem is U.S. Pat. No. 5,125,247 to Mills. The Mills patent discloses a washing machine overflow prevention device signal quality indicator. The device is used with an automatic washing machine in a conventional fixed drain conduit. The device uses a float switch which is adapted to be removeably positioned below the drain hose of the washing machine within the drain conduit. The float is actuated from a normally open to a closed mode when the water level backs up to a predetermined level in the drain conduit. The circuit is electrically connected to the float switch and interposed between a washing machine and an electrical outlet for interrupting electrical power to the washing machine upon actuation of a float switch going from the normally open to the closed mode. Other representative patents trying to solve the above problem are U.S. Pat. No. 5,028,910 to Mescham et al., U.S. Pat. No. 5,026,954 to Cebulski, U.S. Pat. No. 4,814,752 to Lehman and U.S. Pat. No. 4,418,712 to Braley.

There is a need in the art of washing machine overflow sensor systems for a system which includes a simple to use and easy to manufacture system which will monitor a washing machine either in a discharge tub or a drain conduit.

SUMMARY OF THE INVENTION

One object of the present invention is to provide a novel water level sensor and alarm for use with a washing machine.

Another object of the present invention is to provide a water level sensor and alarm system which once activated will not turn the washing machine back on until the control box reset switch is pushed.

Another object of the present invention is to provide a water level sensor and alarm system which will keep the washing machine off whenever water is sensed on the probes.

To achieve the foregoing objects, the present invention is a water level sensor and alarm system. The water level sensor and alarm system includes a control box, a control circuit, and at least one probe. These components will be used to monitor a wash tub basin or drain conduit for overflow water being spilled out of the washing machine during the pump/rinse cycle. Once the water reaches the sensor probe, power will be shut off to the washing machine thus stopping the overflow.

One advantage of the water level sensor and alarm system is that it will not reactivate the washing machine unless the reset switch on the control box is physically pressed.

Another advantage of the present invention is that if the voltage regulator fails the relay will drop out thus turning off power to the washing machine and keeping the overflow water from spilling.

Another advantage of the water level sensor and alarm system is that it is easily installed with a present day washing unit and the cost to manufacture the system is low.

Other objects, features and advantages of the present invention will be readily appreciated as the same becomes better understood after reading the following description taken in conjunction with the accompanying drawings.

DESCRIPTION OF THE BEST MODE AND PREFERRED EMBODIMENT(S)

Figure 1:
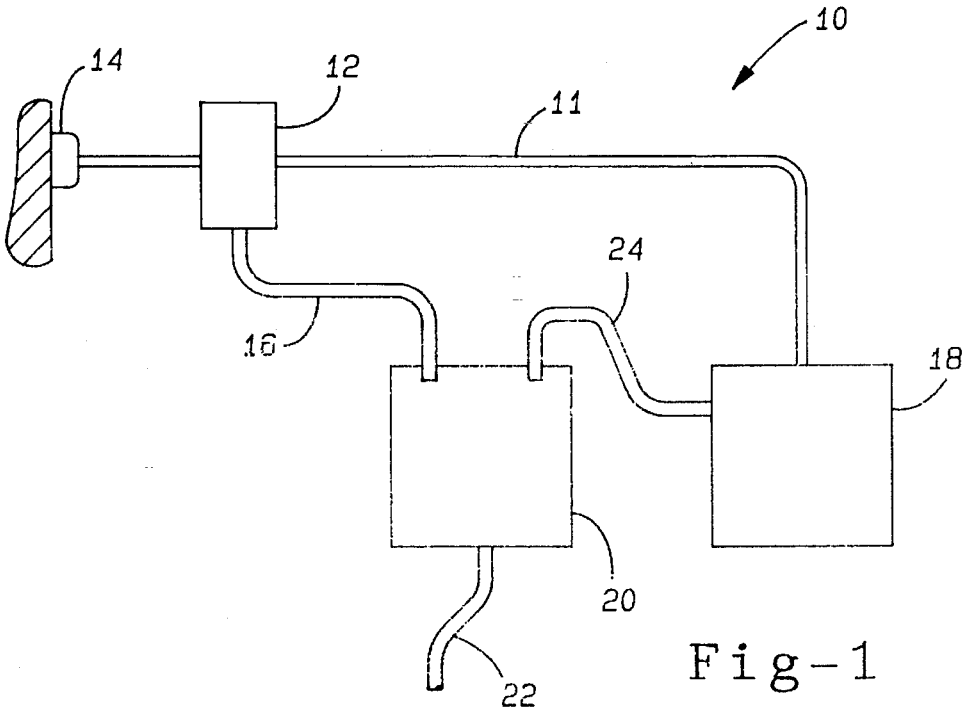
FIG. 1 is a block diagram of the water level sensor and alarm system.

Referring now to FIG. 1, the basic components of the water level sensor and alarm system 10 for use with a washing machine 18 are shown. The system will be used to turn off the washing machine 18 in the event of a water overflow of the discharge sink 20 or drain conduit during the pump/rinse cycle of the washing machine 18. The system 10 may cut the power to the washing machine 18 in one of two methods. In the first method the power is turned off to the pump motor. In the second method the power is turned off to the entire washing machine 18. The preferred embodiment will cut the power to the entire washing machine by stopping all voltage being received from an AC outlet.

The water level sensor and alarm system 10 includes a control box 12, which is connected to at least one probe 38, the probes 38 are placed within a water discharge tub 20 or a drain conduit. The control box 12 is further connected to a washing machine 18 via an electrical connection 11. The washing machine discharge hose 24 is placed within a discharge tub 20 or sink which in turn drains itself into a drain conduit 22. The control box 12 is connected either via a cord 14 to an AC standard house outlet or to an AC outlet directly via a plug 14 in the back of the control box 12. The system may also run on European 240 volt circuits.

Figure 2:
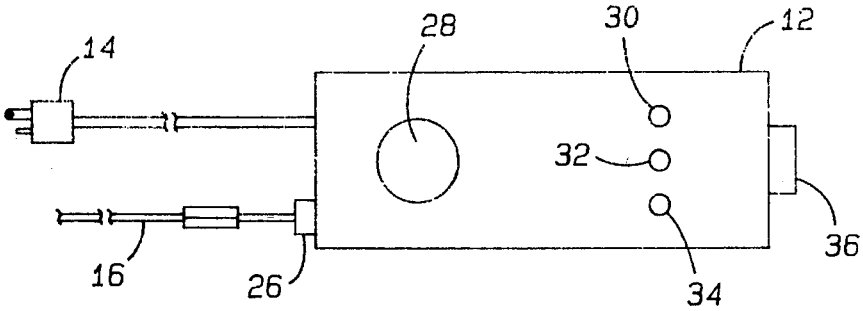
FIG. 2 is a view of the control box of the water level sensor and alarm system.

The control box 12 as seen in FIG. 2 includes an AC plug 14 which is used in conjunction with a standard household alternate current receptacle. The control box 12 also includes an audio jack 26 which is used to plug the probe sensor 38 into the control box 12. The control box 12 also includes an alarm 28 which may transmit an audio and/or visual signal that the overflow mechanism has been engaged and all power has been cut to the washing machine 18. The control box 12 also includes a green LED 30 and a red LED 34. The green LED 30 will light when the system is ready and set to monitor the overflow basin. The red LED 34 indicates that an alarm has been activated, that the overflow water in the discharge basin 20 has reached the probes 38 and that all power is being turned off to the washing machine 18. The reset switch 32 is also located on the control box 12, this will allow the water level sensor and alarm system 10 to be reset. The system 10 has to be reset any time the alarm has gone off or if there has been a power failure within the household environment. Until the system 10 is reset, the control box 12 will not allow any power to the washing machine unit 18.

Figure 3:
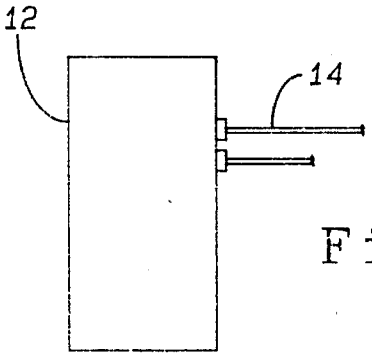
FIG. 3 is a side view of an alternate embodiment of the water level sensor and alarm system.

An alternate embodiment for the control box 12 can be seen in FIG. 3. This embodiment includes all the same functions and features of the preferred embodiment control box, however, the AC plug 14 is built directly into the control box unit 12 such that the control box 12 will plug into the AC outlet of the users home. By pressing the reset switch on the control box 12, the unit will be placed in the ready mode. The ready mode indicates that the unit is monitoring the probes 38 for any water which may come in contact with the probe 38.

Figure 4:
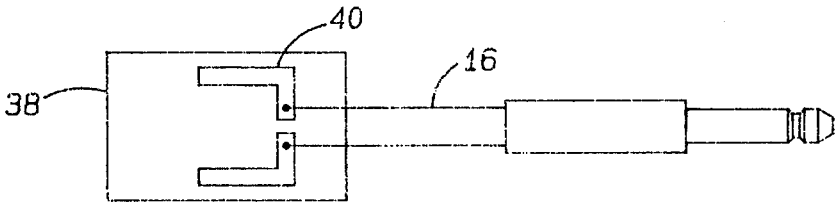
FIG. 4 is a view of the probe.

The probe 38 as seen in FIG. 4 is used to detect a level of rising water within the discharge tub 20. The probe 38 is attached to the control box 12 via the audio jack 16. The probes 38 are positioned approximately five inches from the top of the water tub 20 and/or sink.

Figure 5:
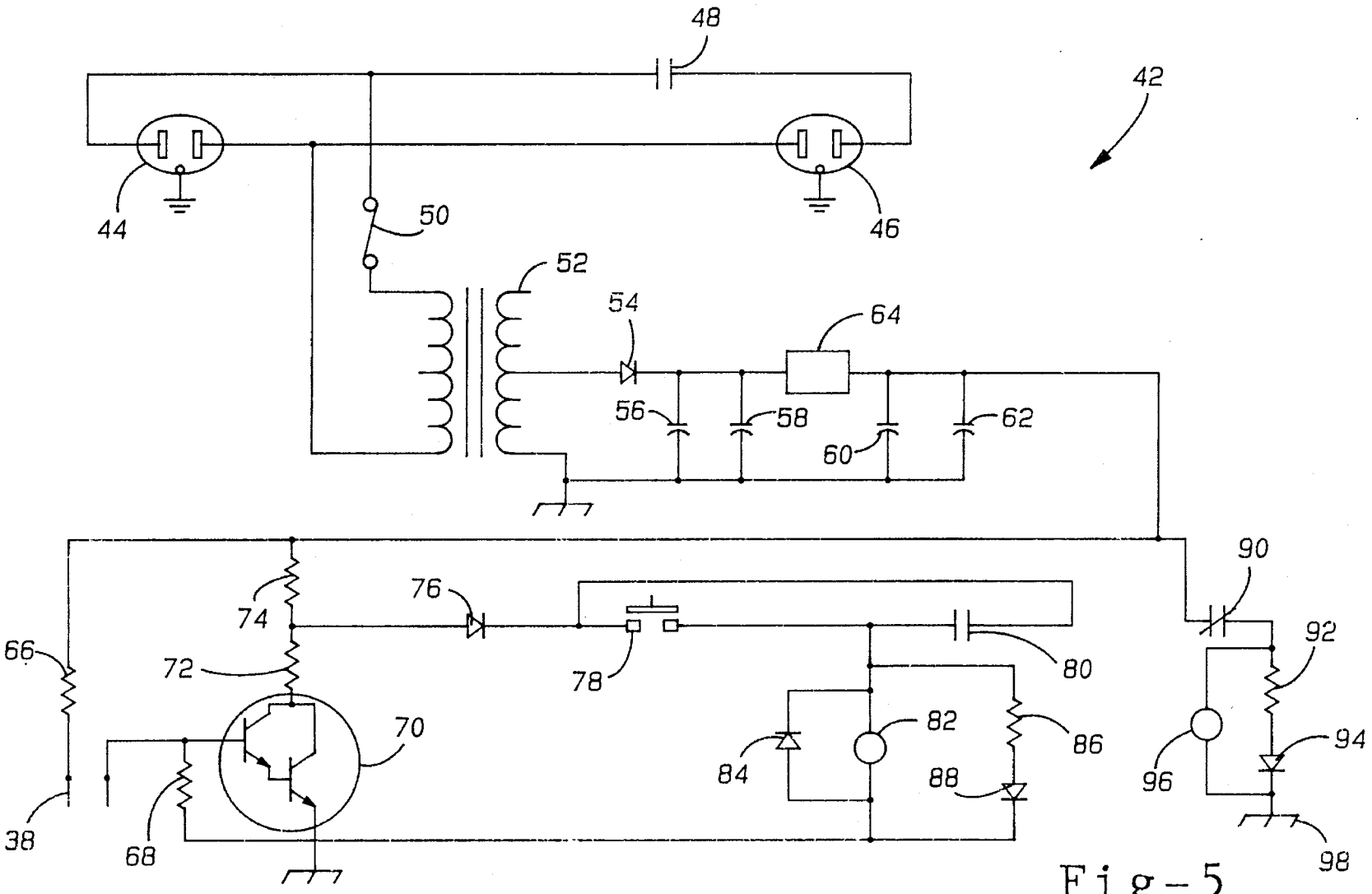
FIG. 5 is a schematic of the control circuit.

The control box 12 also includes a control circuit 42 as shown in FIG. 5. The control circuit 42 includes three basic sections. The first is a DC power source, the second is a relay switching circuit, the third is an input liquid level sensor circuit. The washer overflow control circuit 42 will monitor the probes 38 and determine when to cut electrical power to the washing machine 18. The DC power source circuit preferably uses 110 volt AC current. However, the European 240 volt AC voltage may be used. The 110 volt AC is fed directly into the primary windings of transformer 52. The fuse 50, preferably a one amp fuse is placed on the positive terminal of the AC input to the transformer 52. The output from the transformer 52 is twenty four volt AC, this output is rectified through diode 54 and then the signal is filtered through capacitor 56 and capacitor 58. The rectified and filtered signal is then fed into the input of a twelve volt DC regulator 64. The signals leaves the regulator 64 as a twelve volt DC output. This output is once again filtered through capacitor 60 and capacitor 62 and then supplies all the DC power necessary to the control circuitry.

The relay switching circuitry is used to control the voltage being sent to the washer unit 18. In the preferred embodiment a triple pole formed C twelve volt DC relay 82 with a ten amp rated contact is used to control the washing machine 18. The contacts of the relay 82 are normally open and able to deliver AC power to the washing machine 18. Once the contacts become closed, the power being delivered to the washing machine 18 will be turned off. A further relay switching circuit is used to latch the relay 82 in the on position. The circuit for latching relay 82 includes relay 80 which works in the normally open position. If the unit has been turned off, then the contacts of relay 80 will be closed and the switch 78 will have to be pushed to reset the contacts to their normally open position. The relay switching circuitry also controls the use of the alarm 96 and a light emitting diode 94 to signal that an alarm has been sent. The relay 90 used to control the alarm is usually in the normally closed position. Therefore, once the relay 90 is opened the alarm will sound and the red light emitting diode 94 will be turned on. These relays control the operation of the control circuit and control the overall operation of the water level sensor and alarm system 10.

The input liquid level sensor circuit is connected to a plurality of probes 38. The probes 38 are connected to the base of a Darlington transistor 70. The base of the Darlington transistor 70 is connected to resistor 68, to ground 98, and to relay 82. The relay 82 in turn is connected to an LED 88 and a resistor 86 and the relay 82 has a diode 84 across its terminals. The relay 82 is also connected to relay 80 which is connected to diode 76, the relay 80 is connected to a switch 78 which is used to reset the entire circuit. The Darlington transistor 70 is also connected to four resistors in order to properly bias the Darlington transistor 70. The biasing resistors (74, 72, 66) are connected to the output of the twelve volt DC transformer 64. The transformer 64 is connected to the washer unit 18 and an external AC plug 44. Another relay 90, LED 94 and resistor 92 configuration is connected to the Darlington transistor 70 in order to control the alarm and its audible level. The input liquid level sensor circuit thus controls the availability of power to the washing unit by sensing water in the probes.

The one amp fuse 50 used on the input AC is used to protect the circuitry downstream.

Figure 6:
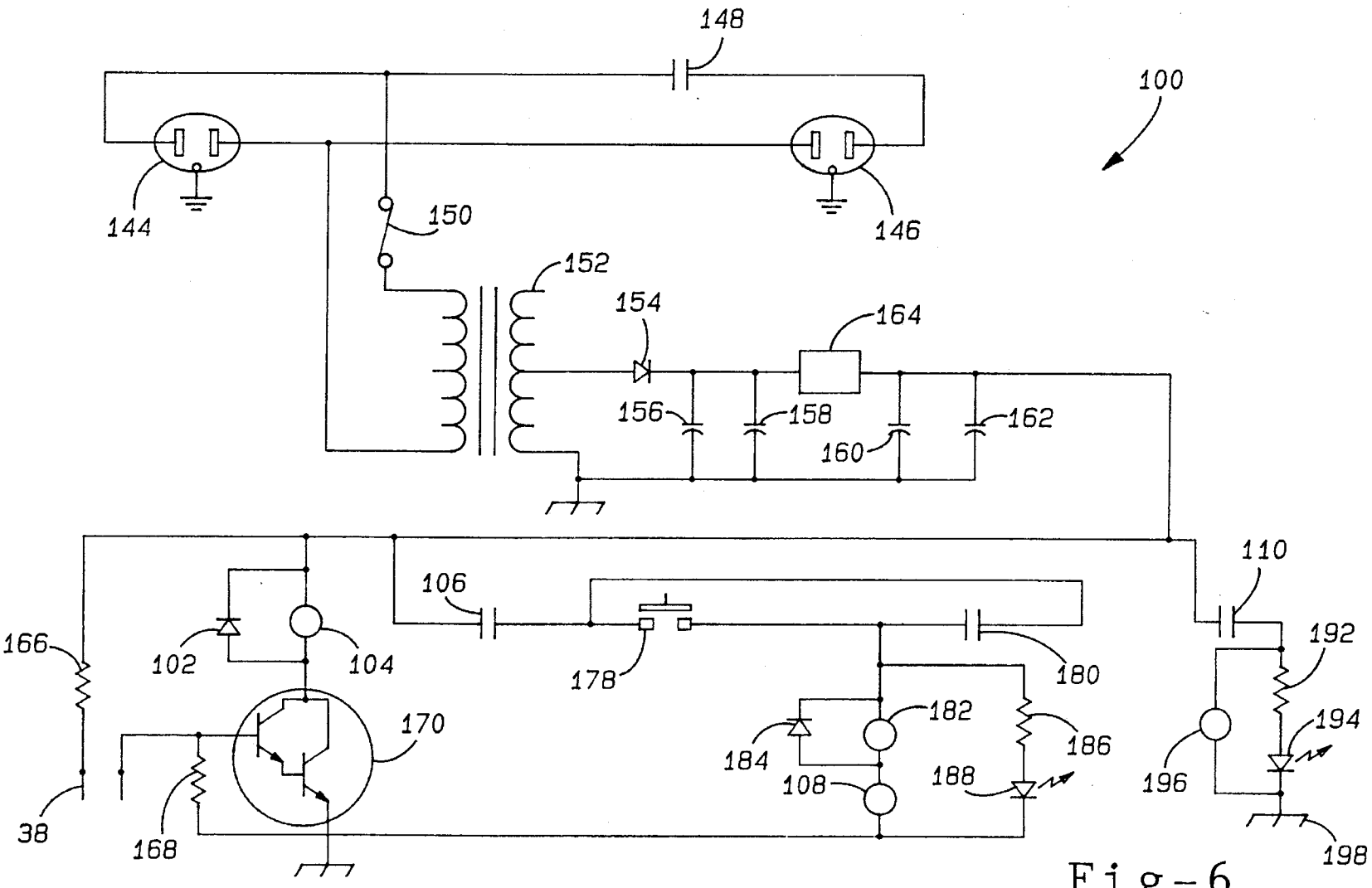
FIG. 6 is an alternate embodiment of the control circuit.

FIG. 6 shows an alternate embodiment of the control circuit 100. The DC power source circuit is the same as the power circuit in FIG. 5. The relay switching circuit includes a double pole "3C" twelve V DS relay 182 which controls power to the washing machine 18. The normally open contacts 148 deliver the power to the washing machine 18. Normally open contacts 180 are connected to relay 182 and will latch relay 182 in the ON position, when switch 178 is momentarily pressed. A clamping diode 184 is placed across relay 182. A thermal fuse 108 is placed between relay 182 and the Darlington transistor 170. A resistor 186 and green LED 188 are connected across relay 182 and the thermal fuse 108 to indicate the circuit is in a ready mode. A twelve V DC low contact current relay 104 is connected to the Darlington transistor 170 and is used to interface the detection input. Normally open contacts 110 are then used to control the audible and light alarm. A clamping diode 102 is connected across relay 104. The input liquid level sensor circuit includes Darlington transistor 170, a resistor 168, and resistor 166.

In operation, the control circuit works in the following manner. When the unit is first plugged into a standard wall outlet 44, the output of the voltage regulator 64 is fed through the normally closed contacts of the relay 90 turning the red LED 94 on and sounding the alarm 96. The system 10 will assume that there is no water surrounding the probes 38 and this in turn will put the Darlington transistor 70 in the off position. Next, with the transistor 70 in the off position and the alarm sounding, the switch 78 is momentarily closed, this will complete the circuit and present sufficient voltage to the coil of relay 82 to energize it. Once the relay 82 has been energized, it will continue to be energized through its own set of relay contacts 80. The system 10 will also turn on the green LED 88 which indicates that the system is ready because power is now being fed through its normally open contacts 80. The energizing of relay 82 will also turn off normally closed contacts 90. This in turn will turn off the alarm 96 and the red LED 94. The system 10 therefore is now in the ready state. Alternating current power is now available to the receptacle 46 where the washing machine 18 is plugged in. This will allow the washing machine 18 to operate in its normal manner.

The probes 38 are placed approximately five inches from the top of the wash tub 20 and/or drain conduit 22. However, the probes 38 may be placed at any suitable position. The circuitry will then monitor the probes 38 to determine when the water begins to overflow. When the water completely surrounds the probes 38, it will short the probes out which will turn on the Darlington transistor 70. This in effect will cause the Darlington transistor 70 to pull its collector toward the ground potential 98. With the collector of Darlington transistor 70 being drawn towards ground potential 98, this will cause the relay 82 to turn off since it will not have enough power to keep itself in the on mode. Once the relay 82 turns off, it will in turn open the relay contacts 48 which will turn the power supplied to the washing machine 18 off. While all of this is occurring, the green LED 88 will also turn off while the red LED 94 along with the audible alarm 96 will once again be turned on. The diode 84 which surrounds relay 82 is used as a clamping diode. While resistors 74, 72, and 66 are used to properly bias the Darlington transistor 70 and provide enough power to turn relay 82 on.

The alternate embodiment circuit of FIG. 6 operates in nearly the same manner as the circuit of FIG. 5. The circuit 100 is placed in the ready state by pressing switch 178 which will energize relay 182. Relay 182 remains energized by contacts 180. When water shorts out the probes 38, the Darlington transistor 170 is turned on, which pulls the collector of 170 toward ground potential 198. This will then turn on relay 104, which will cause relay 182 to drop out and turn the power off to the washing machine 18. When relay 104 is turned on this will also cause the audible 196 and light alarms 194 to be turned on through normally open contacts 110.

The present invention may also be used in conjunction with a dish washing machine, or any other type of machine where the monitoring of liquid levels would be useful in preventing overflows.

The present invention has been described in an illustrative manner. It is to be understood that the terminology which has been used is intended to be in the nature of words of description rather than of limitation.

Any modifications and variations of the present invention are possible in light of the above teachings. Therefore, within the scope of the appended claims, the present invention may be practiced otherwise than as specifically described.

What is claimed is:

1. A water level sensor and alarm for use with a washing machine, said washing machine receiving a water supply at predetermined intervals and removing said water at predetermined intervals in a cycle of the washing machine, the water level and alarm system comprising:

a control box, said control box includes a control circuit;

at least one probe which will be placed within a water discharge tub or sink in order to monitor the level of water in said tub or sink, said probe includes at least one conductive foil and a thin plastic covering that includes an adhesive backing;

said control box is connected to said washing machine electronically and said control box is also connected to a power supply.

2. The water level and alarm system of claim 1 wherein said control circuit includes a step down transformer, a first resistor, a second resistor, a third resistor, a fourth resistor, a fifth resistor, a sixth resistor, a first capacitor, a second capacitor, a third capacitor, a fourth capacitor, a first diode, a second diode, a third diode, a first transistor, a first contact, a second contact, a third contact, and a relay.

3. The water level and alarm system of claim 1 wherein said control circuit includes a step down transformer, a first resistor, a second resistor, a third resistor, a fourth resistor, a first capacitor, a second capacitor, a third capacitor, a fourth capacitor, a first diode, a second diode, a third diode, a first relay, a second relay, a first contact, a second contact, a third contact, a fourth contact and a transistor.

4. A water level sensor and alarm system for use with a washing machine, said washing machine is connected to an AC outlet via a control box, said washing machine is further connected to a water supply said washing machine also includes a water discharge hose which is placed within a water discharge tub or sink, said water level and alarm system comprising:

a control box which is connected to an AC power supply source, said control box includes a LED, said control box also includes an audio and visual alarm, said control box also includes a control circuit, said control circuit includes a power source means for supplying DC voltage to said circuit, a relay switching means for controlling power to the washing machine, an input liquid level sensor means for detecting liquid and sending an electric signal;

said power source means includes a step down transformer connected to a fuse, said fuse connected to a first set of contacts and AC power source, said step down transformer connected to a diode, a first capacitor, a second capacitor, a voltage regulator, a third capacitor, and a fourth capacitor, said power source means will convert AC voltage to a twelve volt DC signal;

said relay switching means being connected to said power source means, said relay switching means includes a capacitor connected to said power source means, said capacitor is also connected to a switch and a second out of contacts, said switch is connected to a first relay, a second diode and a first resistor, a thermal fuse is connected to said first relay and said second diode, a LED is connected to said first resistor and said thermal fuse, a third set of contacts is connected to said power source means, a second resistor is connected to said third set of contacts and said audio and visual alarm, said second set of contacts is used to latch said first relay in an ON position;

said input level liquid sensor means includes a second relay connected to said power source means, a third diode connected across said second relay, a Darlington transistor connected to said second relay, a second resistor connected between a probe and said second relay, a third resistor connected between said probe and said transistor, said second relay is used to interface a detection input from said probe;

a probe which is connected to said control box and placed at the predetermined position within a water discharge tub to monitor a level of water in said tub, said probe includes a standard audio jack at one end thereof, said audio jack is connected to a predetermined length of wire, said wire is then connected to said probe, said probe includes at least one conductive foil and a thin plastic adhesive backing; and said control box being connected to said washing machine via a predetermined length of wire, said control box will monitor said probe and once the water level of said tub comes in contact with said probe, the power will be cut via the control box to the washing machine.

5. A water level sensor and alarm system for use with a washing machine, said washing machine is connected to an AC outlet via a control box, said washing machine is further connected to a water supply system said washing machine also includes a water discharge hose which is placed within a water discharge tub or sink, said water level and alarm system comprising:

a control box which is connected to an AC power supply source, said control box includes a LED, said control box also includes an audio and visual alarm, said control box also includes a control circuit, said control circuit includes a step down transformer, a transistor, a first resistor, a second resistor, a third resistor, a fourth resistor, a first set of contacts, a second set of contacts, a third set of contacts, a reset switch, a first diode, a second diode, a third diode, a first capacitor, a second capacitor, a third capacitor, a fourth capacitor, and a first relay and a second relay;

a probe which is connected to said control box and placed at a predetermined position within a water discharge tub to monitor a level of water in said tub, said probe includes a standard audio jack at one end thereof, said audio jack is connected to a predetermined length of wire, said wire is then connected to said probe, said probe includes at least one conductive foil and a thin plastic adhesive backing; and said control box being connected to said washing machine via a predetermined length of wire, said control box will monitor said probes and once the water level of said tub comes in contact with said probes, the power will be cut via the control box to the washing machine.

* * * * *

UNITED STATES PATENT AND TRADEMARK OFFICE

CERTIFICATE OF CORRECTION

PATENT NO. : 5,493,877
DATED : February 27, 1996
INVENTOR(S) : Daniel R. Wickremasinghe It is certified that error appears in the above-indentified patent and that said Letters Patent is hereby corrected as shown below: On the title page: Item [56]

under References Cited,
U.S. Patent No. "2,498,886" should be --2,498,885--

Signed and Sealed this
Twenty-third Day of July, 1996

Bruce Lehman

*Attest:*

BRUCE LEHMAN

*Attesting Officer*

*Commissioner of Patents and Trademarks*